US009909833B1

(12) United States Patent
Huang

(10) Patent No.: US 9,909,833 B1
(45) Date of Patent: Mar. 6, 2018

(54) TITANIUM STABILIZER ROD FOR AN ARCHERY BOW

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/641,266

(22) Filed: Jul. 4, 2017

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/86, 88, 89
See application file for complete search history.

(56) References Cited

U.S. PATENT DOCUMENTS 3,412,725 A * 11/1968 Hoyt, Jr. ..... F41B 5/1426 124/84
3,524,441 A * 8/1970 Jeffery ..... F41B 5/1426 124/89
4,245,612 A * 1/1981 Finlay ..... F41B 5/1426 124/89
4,982,719 A * 1/1991 Haggard ..... F41B 5/1426 124/23.1
5,016,602 A * 5/1991 Mizek ..... F41B 5/1426 124/89
5,339,793 A * 8/1994 Findley ..... F41B 5/1426 124/89
5,511,533 A * 4/1996 Waller ..... F41B 5/1426 124/89
5,520,164 A * 5/1996 Huddleston ..... F41B 5/14 124/86
5,547,162 A * 8/1996 Sobolewski ..... F41B 5/14 124/88
5,613,484 A * 3/1997 Troncoso ..... F41B 5/1426 124/86
5,735,257 A * 4/1998 Walk ..... F41B 5/1426 124/89
6,085,736 A * 7/2000 Osterhues ..... F41B 5/1426 124/89
6,494,196 B2 * 12/2002 Harwath ..... F41B 5/1426 124/89
7,721,724 B2 * 5/2010 Goade ..... F41B 5/1426 124/86
7,958,881 B2 * 6/2011 Silverson ..... F41B 5/1426 124/86
8,365,713 B2 * 2/2013 Grace, Jr. ..... F41B 5/1426 124/89

(Continued)

*Primary Examiner* — Alexander Niconovich
(74) *Attorney, Agent, or Firm* — Donald J. Ersler

(57) ABSTRACT

A titanium stabilizer rod for an archery bow preferably includes a base portion, a middle portion and a weight retention portion. The base portion extends from one end of the middle portion and the weight retention portion extends from an opposing end of the middle portion. A threaded stud extends from the base portion. A threaded tap is formed in the weight retention portion or a weight threaded stud extends from an opposing end of the weight retention portion. A stabilizer weight includes a threaded stud, which is threaded into the threaded tap of the weight retention portion. The stabilizer weight may also include a weight hole. The threaded stud is inserted through the weight hole and retained on the titanium stabilizer rod with a threaded nut. A lengthwise opening is preferably formed through an entire length of the titanium stabilizer rod.

12 Claims, 3 Drawing Sheets

(56) References Cited

U.S. PATENT DOCUMENTS

| | | | | |
|---|---|---|---|---|
| 8,534,273 | B2 * | 9/2013 | LoRocco | F41B 5/1426 124/86 |
| 8,573,193 | B2 * | 11/2013 | Khoshnood | F41B 5/1426 124/86 |
| 9,429,383 | B2 * | 8/2016 | Martens | F41B 5/1426 |
| 2001/0025636 | A1 * | 10/2001 | Harwath | F41B 5/1426 124/89 |
| 2010/0192932 | A1 * | 8/2010 | Brewster | F41B 5/1407 124/89 |
| 2012/0240913 | A1 * | 9/2012 | Stokes | F41B 5/1426 124/89 |
| 2013/0055998 | A1 * | 3/2013 | LoRocco | F41B 5/1426 124/89 |
| 2017/0089661 | A1 * | 3/2017 | Potts | F41B 5/1426 |

* cited by examiner

TITANIUM STABILIZER ROD FOR AN ARCHERY BOW

BACKGROUND OF THE INVENTION

1. Field of the Invention

The present invention relates generally to archery and more specifically to a titanium stabilizer rod for an archery bow, which does not store vibration energy.

2. Discussion of the Prior Art

There are numerous stabilizers for archery bows on the market. However, it appears that the art does not teach or suggest a titanium stabilizer rod for an archery bow. The titanium stabilizer rod does not flex and thus does not store vibration energy. Patent publication no. 2010/0192932 to Brewster discloses an archery bow stabilizer and vibration reducer. Patent publication no. 2012/0240913 discloses an archery bow stabilizer.

Accordingly, there is a clearly felt need in the art for a titanium stabilizer rod for an archery bow, which does not store vibration energy.

SUMMARY OF THE INVENTION

The present invention provides a titanium stabilizer rod for an archery bow, which does not store vibration energy. The titanium stabilizer rod for an archery bow (titanium stabilizer rod) preferably includes a base portion, a middle portion and a weight retention portion. One end of the base portion extends from one end of the middle portion and one end of the weight retention portion extends from an opposing end of the middle portion. A threaded stud extends from an opposing end of the base portion. The threaded stud is threaded into an archery bow. A threaded tap is formed in an opposing end of the weight retention portion or a weight threaded stud extends from an opposing end of the weight retention portion.

A weight for a stabilizer includes a threaded stud, which is threaded into the threaded tap of the weight retention portion. The weight stabilizer may also include a weight hole. The weight threaded stud is inserted through the weight hole and retained on the titanium stabilizer rod with a threaded nut. A lengthwise opening is preferably formed through an entire length of the titanium stabilizer rod. The base portion, the middle portion and the weight retention portion preferably have a round cross sectional shape, but other cross sectional shapes may also be used. The titanium stabilizer rod may also be fabricated from three pieces. The base portion is screwed or pressed fitted into one end of the middle portion. The weight retention portion is screwed or pressed fitted into an opposing end of the middle portion. The titanium stabilizer rod is fabricated from G5 titanium metal or a material, which is stiffer and lighter than the G5 titanium metal.

Accordingly, it is an object of the present invention to provide a titanium stabilizer rod, which does not store vibration energy.

These and additional objects, advantages, features and benefits of the present invention will become apparent from the following specification.

DETAILED DESCRIPTION OF THE PREFERRED EMBODIMENTS

Figure 3:
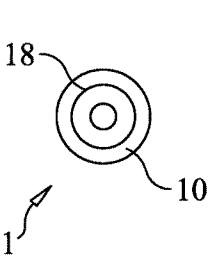
FIG. 3 is an end view of a base portion of a titanium stabilizer rod in accordance with the present invention.
Figure 2:
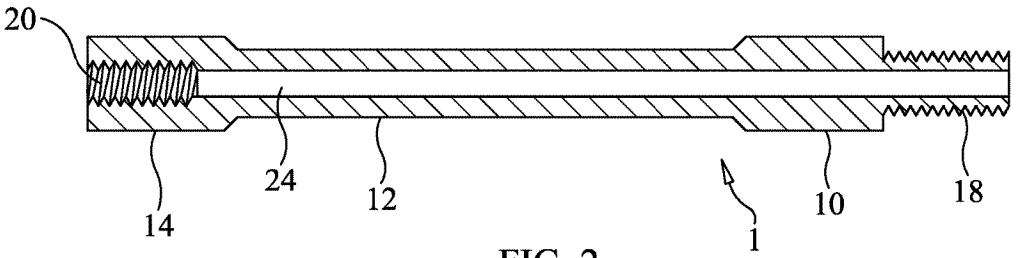
FIG. 2 is a cross sectional view of a titanium stabilizer rod with a weight threaded tap in accordance with the present invention.
Figure 1:
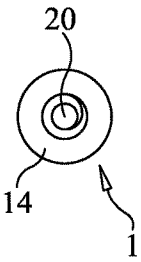
FIG. 1 is an end view of a weight retention portion of a titanium stabilizer rod with a weight threaded tap in accordance with the present invention.
Figure 4:
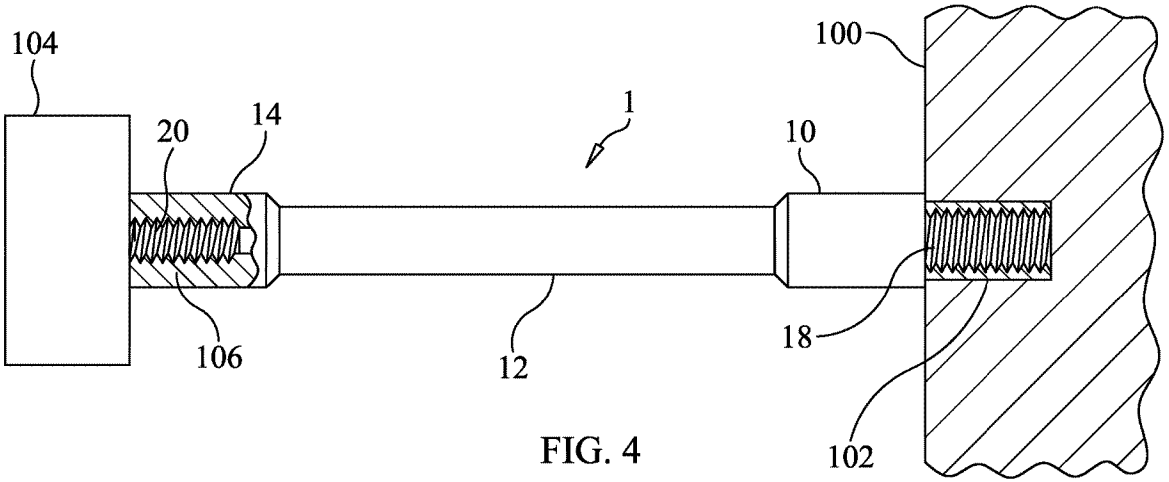
FIG. 4 is a side view of a titanium stabilizer rod mounted to an archery bow with a weight threaded tap and with a stabilizer weight engaged in the weight threaded tap in accordance with the present invention.
Figure 5:
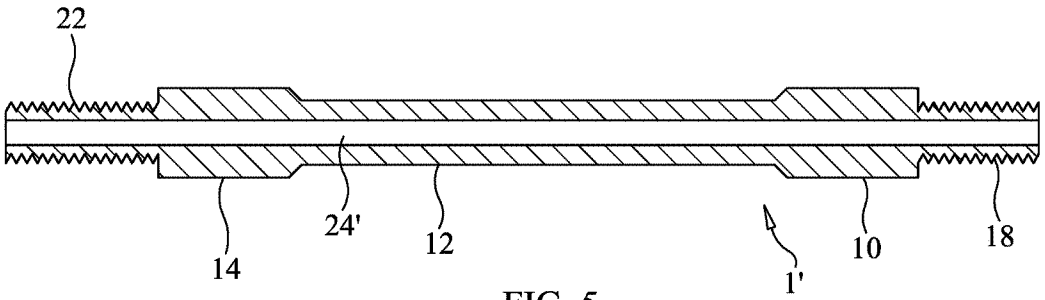
FIG. 5 is a cross sectional view of a titanium stabilizer rod with a weight threaded stud in accordance with the present invention.
Figure 6:
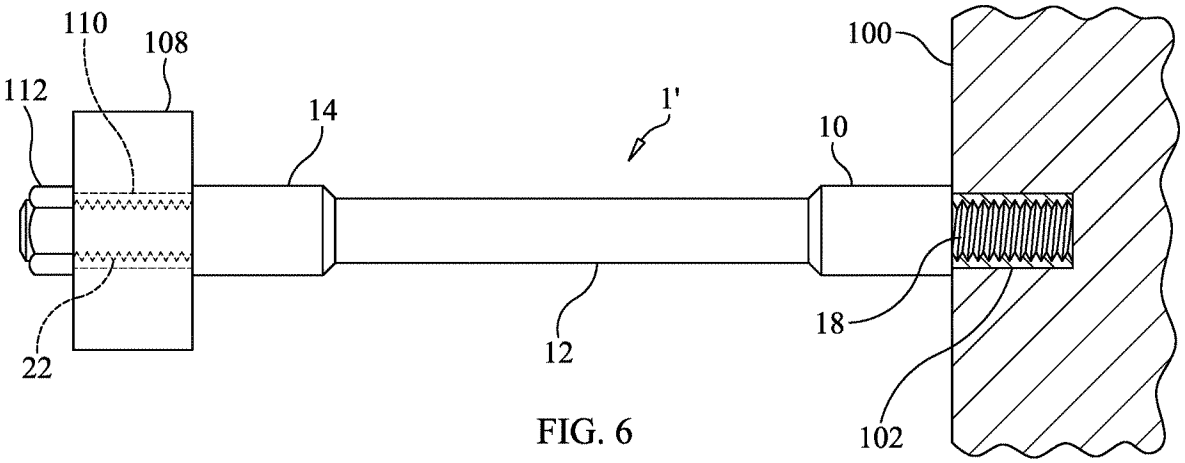
FIG. 6 is a side view of a titanium stabilizer rod mounted to an archery bow with a weight threaded tap and with a stabilizer weight engaged in the weight threaded tap in accordance with the present invention.

With reference now to the drawings, and particularly to FIG. 2, there is shown a cross sectional view of a titanium stabilizer rod 1. With reference to FIGS. 1 and 3, the titanium stabilizer rod 1 preferably includes a base portion 10, a middle portion 12 and a weight retention portion 14. One end of the base portion 10 extends from one end of the middle portion 12 and one end of the weight retention portion 14 extends from an opposing end of the middle portion 12. A threaded stud 18 extends from an opposing end of the base portion 10. With reference to FIG. 4, the threaded stud 18 is threaded into a threaded insert 102 in an archery bow 100. With reference to FIG. 5, a threaded tap 20 is formed in an opposing end of the weight retention portion 14 or a weight threaded stud 22 extends from an opposing end of the weight retention portion 14 of a titanium stabilizer rod 1'. A stabilizer weight 104 includes a threaded stud 106, which is threaded into the threaded tap 20 of the weight retention portion 14. A stabilizer weight 108 may also include a weight hole 110. The weight threaded stud 22 is inserted through the weight hole 110 and retained on the titanium stabilizer rod 1' with a threaded nut 112. A lengthwise opening 24 is formed through an entire length of the titanium stabilizer rod 1 and a lengthwise opening 24' is formed through an entire length of the titanium stabilizer rod 1'. The base portion 10, the middle portion 12 and the weight retention portion 14 preferably have a round cross sectional shape, but other cross sectional shapes may also be used.

Figure 7:
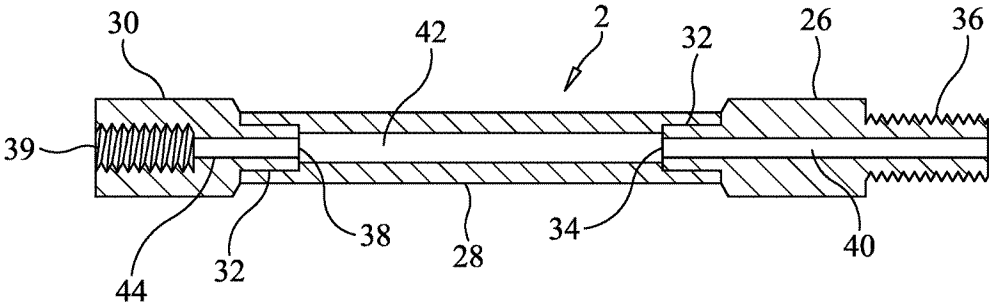
FIG. 7 is a cross sectional view of a hollow three piece titanium stabilizer rod with a weight threaded tap in accordance with the present invention.

With reference to FIG. 7, a three piece titanium stabilizer rod 2 preferably includes a base portion 26, a middle portion 28 and a weight retention portion 30. An end bore 32 is formed in opposing ends of the middle portion 28. The base portion 26 includes a base plug 34 extending from one and a threaded stud 36 extending from an opposing end. The weight retention portion 30 includes a weight plug 38 formed in one end and a threaded tap 39 formed in an opposing end thereof. The base plug 34 is press fitted into the end bore 32 on one end of the middle portion 28 and the weight plug 38 is press fitted into the end bore 32 on an opposing end of the middle portion 30. A base through opening 40 is preferably formed through the base portion 26. A middle through opening 42 is preferably formed through the middle portion 28. A weight through opening 44 is preferably formed through the weigh retention portion 30.

Figure 8:
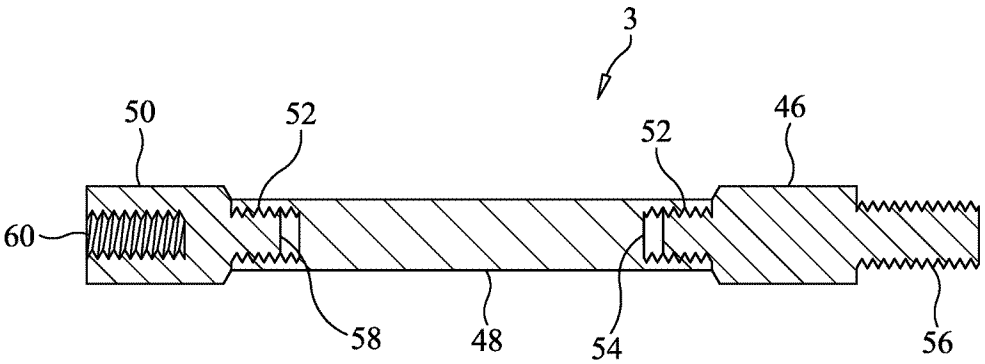
FIG. 8 is a cross sectional view of a three piece titanium stabilizer rod with a weight threaded tap in accordance with the present invention.

With reference to FIG. 8, a three piece titanium stabilizer rod 3 preferably includes a base portion 46, a middle portion 48 and a weight retention portion 50. A threaded tap 52 is formed in opposing ends of the middle portion 48. The base portion 46 includes a base threaded plug 54 extending from one and a threaded stud 56 extending from an opposing end. The weight retention portion 50 includes a weight threaded plug 58 formed in one end and a weight threaded tap 60 formed in an opposing end thereof. The base threaded plug 54 is threaded into the threaded tap 52 on one end of the middle portion 48 and the weight threaded plug 58 is threaded into the threaded tap 52 on an opposing end of the middle portion 48. A through opening may be formed through the base portion 46, the middle portion 48 and the weight rention portion 50.

The titanium stabilizer rod 1, 1' is preferably fabricated from a single piece of G5 titanium metal, or a material which is stiffer and lighter than the G5 titanium metal. The titanium stabilizer rod 2, 3 is preferably fabricated from G5 titanium metal, or a material which is stiffer and lighter than the G5 titanium metal.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A titanium stabilizer rod consisting of:

a middle portion;

a base portion having one end that extends from one end of said middle portion;

a weight retention portion having one end that extends from an opposing end of said middle portion, a threaded tap is formed in an opposing end of said weight retention portion or a threaded stud extends from said opposing end of said weight retention portion, wherein a threaded stud of a male stabilizer weight is threadably retained in said threaded tap or said threaded stud is inserted into a hole in a female stabilizer weight; and a threaded stud extends from an opposing end of said base portion, wherein said threaded stud is threaded into an archery bow, said titanium stabilizer rod is fabricated from a single piece of titanium metal, said titanium stabilizer rod does not flex and consequently does not store vibration energy.

2. The titanium stabilizer rod of claim 1 wherein:

a lengthwise opening is formed through a length of said titanium stabilizer rod.

3. The titanium stabilizer rod of claim 1 wherein:

said base portion, said middle portion and said weight retention portion have a round cross sectional shape.

4. The titanium stabilizer rod of claim 1 wherein:

said titanium metal is G5 titanium.

5. A titanium stabilizer rod comprising:

a middle portion includes an end bore formed in opposing ends thereof, said middle portion is fabricated from titanium metal;

a base portion includes a threaded stud extending from one end and a base plug extending from an opposing end thereof, said base portion is fabricated from titanium metal, said base plug is retained in said end bore in one end of said middle portion; and a weight retention portion includes a weight plug extending from one end or a threaded tap formed in an opposing end of said weight retention portion, said weight retention portion is fabricated from titanium metal, said weight plug is retained in said end bore in an opposing end of said middle portion, wherein said threaded stud is threaded into an archery bow.

6. The titanium stabilizer rod of claim 5 wherein:

a base through opening is formed through said base portion, a middle through opening is formed through said middle portion, a weight through opening is formed through said weigh retention portion.

7. The titanium stabilizer rod of claim 5 wherein:

said base portion, said middle portion and said weight retention portion have a round cross sectional shape.

8. The titanium stabilizer rod of claim 5 wherein:

said titanium metal is G5 titanium.

9. A titanium stabilizer rod comprising:

a middle portion includes an threaded tap is formed in opposing ends thereof, said middle portion is fabricated from titanium metal;

a base portion includes a threaded stud extending from one end and a base threaded plug extending from an opposing end thereof, said base portion is fabricated from titanium metal, said base threaded plug is threaded into said threaded tap in one end of said middle portion; and a weight retention portion includes a weight threaded plug extending from one end or a weight threaded tap formed in an opposing end of said weight retention portion, said weight retention portion is fabricated from titanium metal, said weight plug is threaded into said threaded tap in an opposing end of said middle portion, wherein said threaded stud is threaded into an archery bow.

10. The titanium stabilizer rod of claim 9 wherein:

a base through opening is formed through said base portion, a middle through opening is formed through said middle portion, a weight through opening is formed through said weigh retention portion.

11. The titanium stabilizer rod of claim 9 wherein:

said base portion, said middle portion and said weight retention portion have a round cross sectional shape.

12. The titanium stabilizer rod of claim 9 wherein:

said titanium metal is G5 titanium.

* * * * *